US009533306B2

(12) United States Patent
Chiou et al.

(10) Patent No.: US 9,533,306 B2
(45) Date of Patent: Jan. 3, 2017

(54) SINGLE SIDED CONTINUOUS OPTOELECTROWETTING (SCEOW) DEVICE FOR DROPLET MANIPULATION WITH LIGHT PATTERNS

(75) Inventors: Pei-Yu Chiou, Los Angeles, CA (US); Sung-Yong Park, Thousand Oaks, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 525 days.

(21) Appl. No.: 13/194,966

(22) Filed: Jul. 31, 2011

(65) Prior Publication Data

US 2012/0024708 A1 Feb. 2, 2012

Related U.S. Application Data

(60) Provisional application No. 61/370,009, filed on Aug. 2, 2010.

(51) Int. Cl.
*C25B 7/00* (2006.01)
*B01L 3/00* (2006.01)

(52) U.S. Cl.
CPC .. *B01L 3/502792* (2013.01); *B01L 2300/0816* (2013.01); *B01L 2400/0427* (2013.01)

(58) Field of Classification Search
CPC ..... G01N 27/44721; B01L 3/502792; B01L 2400/0427; B01L 2300/0816
(Continued)

(56) References Cited

U.S. PATENT DOCUMENTS 6,744,038 B2 6/2004 Wang et al.
7,612,355 B2 11/2009 Wu et al.
(Continued)

FOREIGN PATENT DOCUMENTS

WO 2008119066 A1 10/2008
WO 2009046125 A3 4/2009
(Continued)

OTHER PUBLICATIONS

Park, S. et al.—"Light-Driven Microfluidic Platforms for Droplet-Based Biochemical Analysis"—Proc. of SPIE NanoScience & Engineering (SPIE Optics & Photonics), San Diego, CA Aug. 2-6, 2009, pp. 1-11.
(Continued)

*Primary Examiner* — Gurpreet Kaur
(74) *Attorney, Agent, or Firm* — John P. O'Banion

(57) ABSTRACT

A single-sided continuous optoelectrowetting (SCOEW) device for manipulating droplets retained in a fluid over the SCOEW device with dynamic patterns of low intensity light, such as from a display screen, is described. A single pair of lateral electrodes are utilized for providing a lateral electric field bias, with transport motion controlled in response to projecting light through a photoconductive layer and dielectric layer adjacent to which droplets are retained. The device is configured for optically manipulating droplets having volumes spanning over five orders of magnitude, and can be configured to perform droplet dispensing, transport, splitting, merging, mixing and other droplet manipulation functions involving any of the above on a single sided surface.

26 Claims, 16 Drawing Sheets

(58) Field of Classification Search
USPC ..... 204/600, 660, 663; 347/54, 58, 74–78, 347/81, 55
See application file for complete search history.

(56) References Cited

U.S. PATENT DOCUMENTS

| | | | | |
|---|---|---|---|---|
| 7,727,771 | B2 | 6/2010 | Chiou et al. | |
| 2005/0045479 | A1* | 3/2005 | Weigl et al. | 204/603 |
| 2007/0243110 | A1* | 10/2007 | Chiou et al. | 422/100 |
| 2010/0133105 | A1* | 6/2010 | Lau | 204/451 |
| 2011/0005931 | A1* | 1/2011 | Zhe et al. | 204/451 |
| 2012/0091003 | A1* | 4/2012 | Chuang | B03C 5/02 204/547 |

FOREIGN PATENT DOCUMENTS

| | | | |
|---|---|---|---|
| WO | 2009111769 | A3 | 9/2009 |
| WO | 2010009463 | A3 | 1/2010 |

OTHER PUBLICATIONS

Park, S. et al.—"Single-sided continuous optoelectrowetting (SCOEW) for droplet manipulation with light patterns"—Lab on a Chip, vol. 10, No. 13, Jul. 7, 2010, pp. 1655-1661.

Park, S. et al.—"Single-Side Continuous Optoelectrowetting (SCOEW) for Light-Actuated, Volume-Tuned Droplet Injection, Transportation, and Mixing"—13th Int. Conf. on Miniaturized Systems for Chemistry and Life Sciences, Jeju, Korea, Nov. 1-5, 2009, pp. 1-3.

Chiou, P.Y. et al.—"Massively parallel manipulation of single cells and microparticles using optical images"—Nature, vol. 436, Jul. 21, 2005, pp. 370-372.

Park, S.Y. et al.—"Single-sided continuous optoelectrowetting (SCOEW) for droplet manipulation with light patterns"—Lab Chip, vol. 10, 2010, pp. 1655-1661.

Ohta A.T. et al.—"Dynamic cell and microparticle control via optoelectronic tweezers"—Journal of Microelectromechanical Systems, vol. 16, No. 3, Jun. 2007, pp. 491-499.

* cited by examiner

No Voltage On

Voltage On 2-mm Image 3.5-mm Image

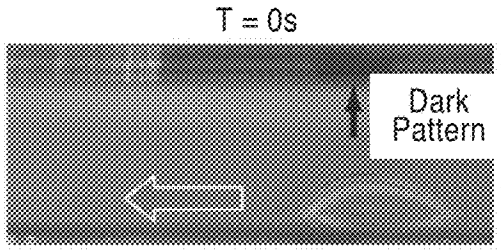
50μL Water Droplet
FIG. 6A
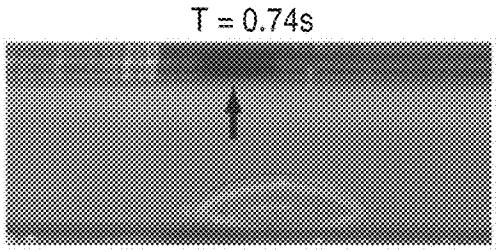
50μL Water Droplet
FIG. 6B
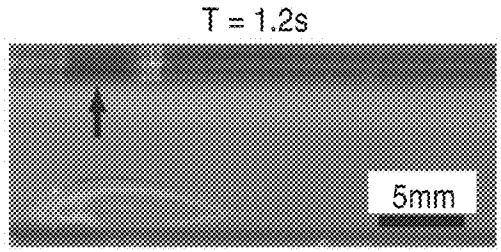
50μL Water Droplet
FIG. 6C
250pL Green-Colored Dye Droplet
FIG. 7A
250pL Green-Colored Dye Droplet
FIG. 7B
250pL Green-Colored Dye Droplet
FIG. 7C 1μL Droplet 20nL Droplet 1μL Droplet 20nL Droplet 1μL Droplet 20nL Droplet 1μL Droplet 20nL Droplet Two Different Droplets T=0s, Combined Droplet T=2s T=4s T=5s

SINGLE SIDED CONTINUOUS OPTOELECTROWETTING (SCEOW) DEVICE FOR DROPLET MANIPULATION WITH LIGHT PATTERNS

CROSS-REFERENCE TO RELATED APPLICATIONS

This application claims priority from U.S. provisional patent application Ser. No. 61/370,009 filed on Aug. 2, 2010, incorporated herein by reference in its entirety.

STATEMENT REGARDING FEDERALLY SPONSORED RESEARCH OR DEVELOPMENT

This invention was made with Government support under Grant No. 0747950, awarded by the National Science Foundation. The Government certain rights in this invention.

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to optoelectrowetting, and more particularly to single-sided continuous optoelectrowetting for droplet manipulation with light patterns.

2. Description of Related Art

Droplet-based microfluidic systems have attracted broad interest for lab-on-chip applications. Demonstrated droplet manipulation technologies are versatile and include surface acoustic wave, thermocapillary force electrowetting-on-dielectric (EWOD), dielectrophoresis (DEP), and magnetic forces. Among these systems, EWOD provides advantages in regard to fast response times, simple implementations, and large force application at millimeter to micrometer scales. EWOD-based applications, such as polymerase chain reaction (PCR) clinical diagnostics, DNA enrichment and ligation, proteomics, electronic paper, and on-chip cooling have been shown.

Conventional EWOD devices are typically implemented by sandwiching droplets between two parallel plates fabricated with one or more arrays of addressable electrodes. Actuation is achieved by digitally addressing these electrodes to induce transport from one set of electrodes to another. Certain single-sided EWOD devices integrate actuating and ground electrodes on the same substrate allowing manipulating larger droplet volumes per sample footprint, improved droplet mixing efficiencies, and flexible integration with other components such as optical detectors and external sample reservoirs.

Recent optoelectrowetting (OEW) mechanisms enable optical manipulation of droplets using light beams to overcome complex wiring and interconnect issues faced by EWOD devices using physical metal electrodes when addressing a large number of droplets in parallel on a 2D surface. Droplets manipulated in electrowetting-based devices are typically sandwiched between two parallel plates and actuated by digital electrodes. The size of pixilated electrodes limits the minimum droplet size that can be manipulated. To overcome size limitations of pixilated electrodes, a continuous optoelectrowetting device (COEW) mechanism was developed that enables continuous transportation of picoliter (pL) droplets sandwiched between two featureless and closely positioned electrodes (15 μm separation gap), one transparent Indium Tin Oxide (ITO) electrode and one photoconductive amorphous silicon electrode. However, the thick amorphous silicon layer used in COEW for matching the electrical impedance of the dielectric layer is difficult to reproduce due to large residual stress during the deposition process. Large voltage leaks in areas not covered by droplets also resulted in droplet instability issues while satellite droplets ejected from mother droplets were often observed during experiments.

Accordingly, a need exists for electrowetting droplet manipulation devices and methods which are simpler to implement while providing high accuracy.

BRIEF SUMMARY OF THE INVENTION

An inventive single-sided continuous optoelectrowetting (SCOEW) mechanism is described herein that enables light-patterned electrowetting modulation for continuous droplet manipulation on an open, featureless, and photoconductive surface. SCOEW overcomes the size limitation of physical pixilated electrodes by utilizing dynamic and reconfigurable optical patterns and enables the continuous transport, splitting, merging, and mixing of droplets with volumes ranging from 50 μL to 250 pL, representing a droplet volume range of over five orders of magnitude. This single-sided open configuration provides a flexible interface for integration with other microfluidic components, such as connecting to sample reservoirs through simple tubing as described herein. Parallel droplet injection is demonstrated using SCOEW which is light-triggered and volume-tunable, while providing less than 1% volume variation. The unique lateral field-driven optoelectrowetting mechanism of SCOEW also enables extremely low light intensity actuation, and droplet manipulation can be achieved by directly positioning the SCOEW chip on a display screen, such as on the LCD screen of a laptop computer, portable cellular phone, or other available device.

Further aspects and embodiments of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

FIG. 6A through FIG. 6C are images of continuous transportation on a 50 μL droplet according to an embodiment of the present invention.

FIG. 7A through FIG. 7C are images of continuous transportation on a 250 pL droplet according to an embodiment of the present invention.

DETAILED DESCRIPTION OF THE INVENTION

1. Introduction to SCOEW

By way of example, and not of limitation, the present invention is a single-sided continuous optoelectrowetting (SCOEW) device which enables continuous light-patterned electrowetting on a featureless (e.g., no directing channels, electrodes, or other structures) photoconductive surface. It provides several advantages over conventional EWOD and OEW devices, including (a) a single-sided open chamber configuration allows easy integration with other microfluidic components such as sample reservoirs; (b) a continuous photoconductive surface enables droplets to be continuously positioned at any location on a 2D surface; (c) the droplet size limitation determined by the size of physical pixilated electrodes is completely eliminated; and (d) compared to any previously demonstrated OEW devices, the lateral field-driven optoelectrowetting mechanism can be operated with extremely low light intensity, such as generated from a display (e.g., LCD display) without the need of lenses or other optical components.

2. SCOEW Device Structure and Light-Actuation Principle

Figure 1:
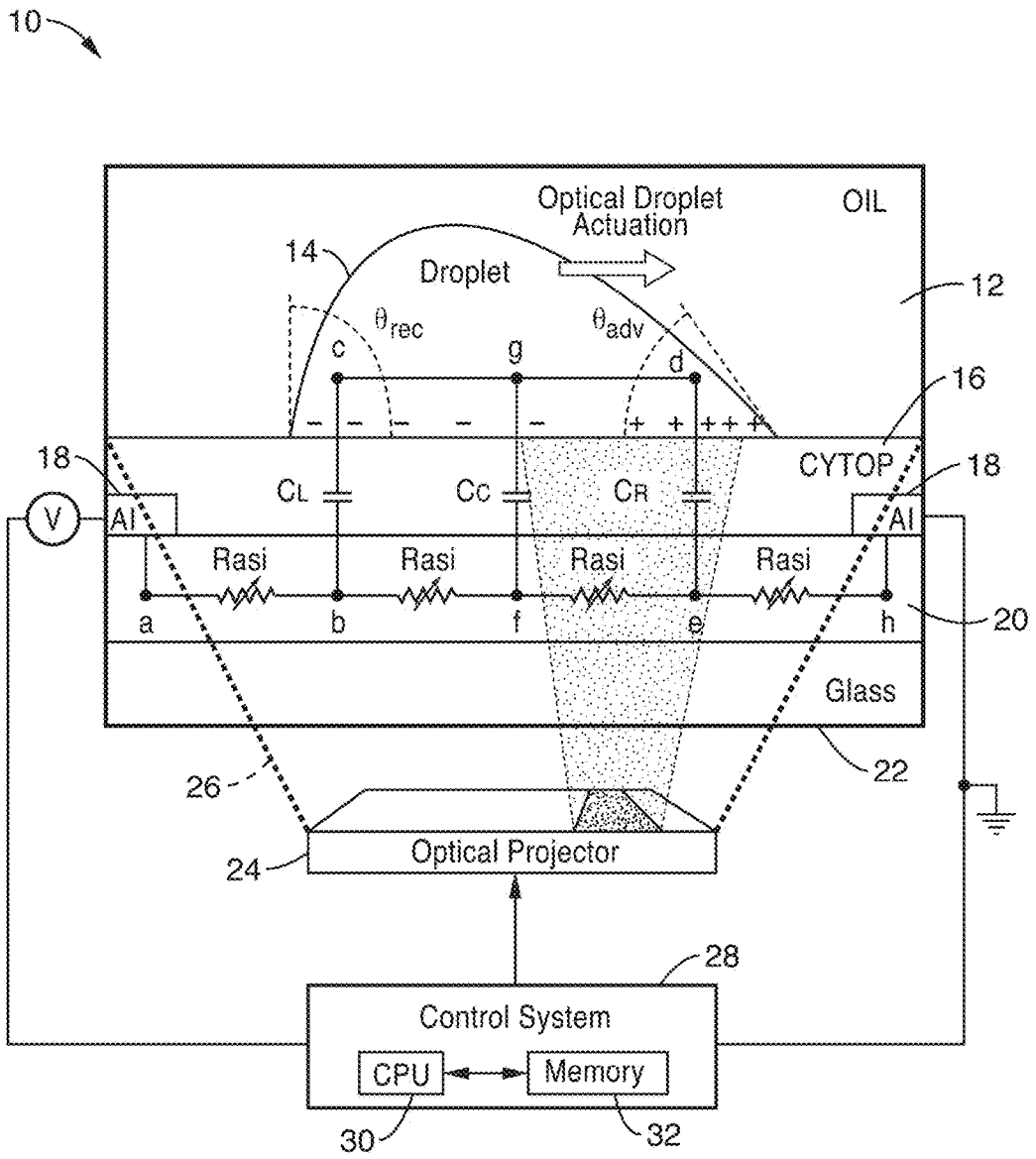
FIG. 1 is a schematic of a single-sided continuous opto-electrowetting (SCOEW) device according to an embodiment of the present invention.
Figure 2A:
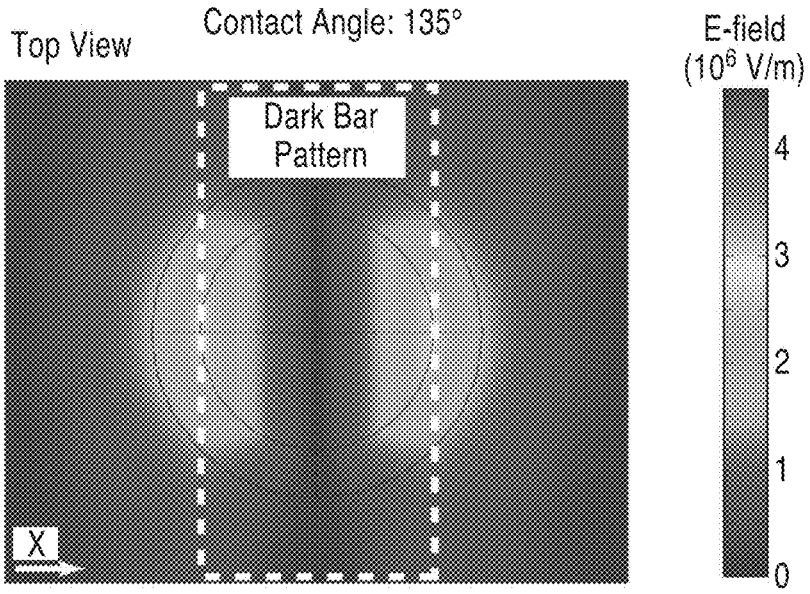
FIG. 2A through FIG. 2C are graphs of electric field simulations around a droplet with an initial contact angle of 135° under illumination of various dark-bar patterns according to an embodiment of the present invention, showing two-dimensional patterns and voltage drops.
Figure 2B:
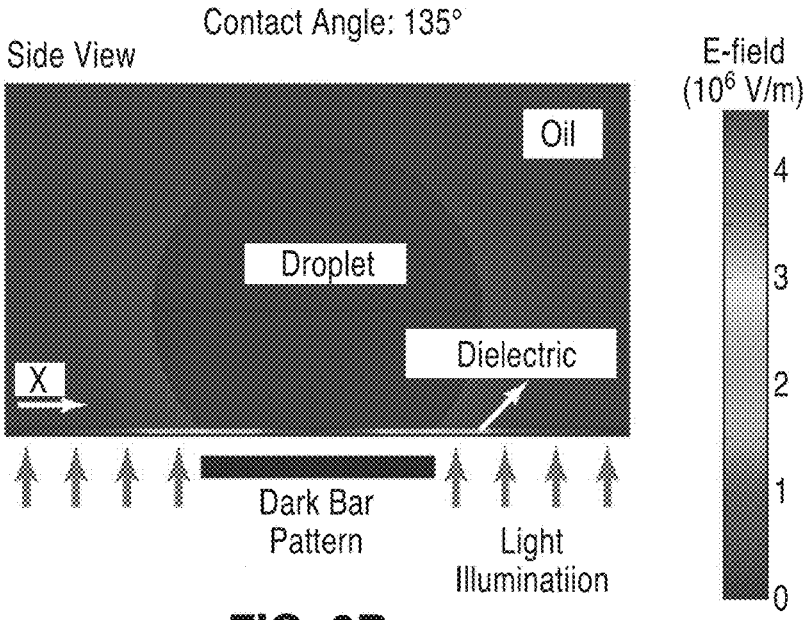
Figure 2C:
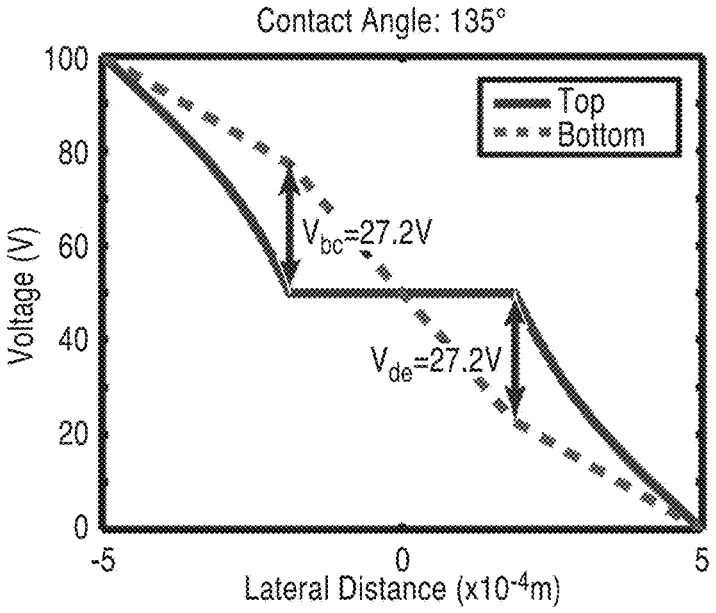
Figure 3A:
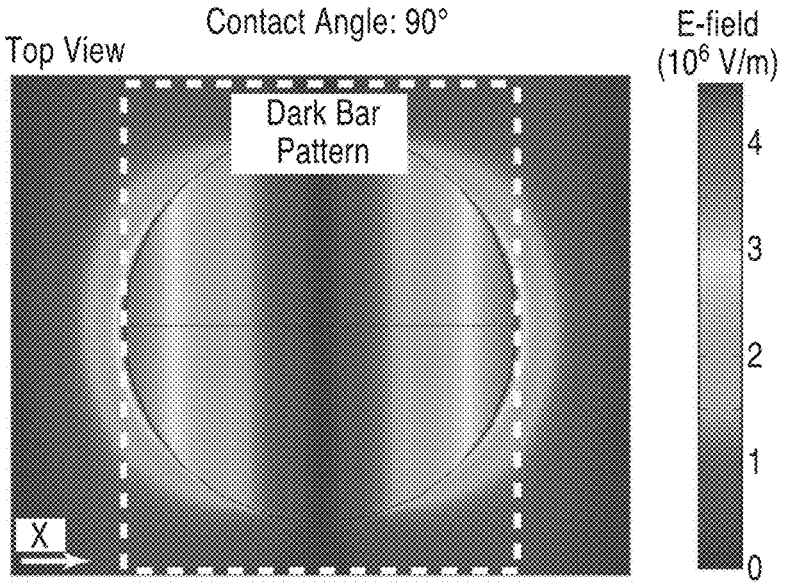
FIG. 3A through FIG. 3C are graphs of electric field simulations around a droplet with an initial contact angle of 90° under illumination of various dark-bar patterns according to an embodiment of the present invention, showing two-dimensional patterns and voltage drops.
Figure 3B:
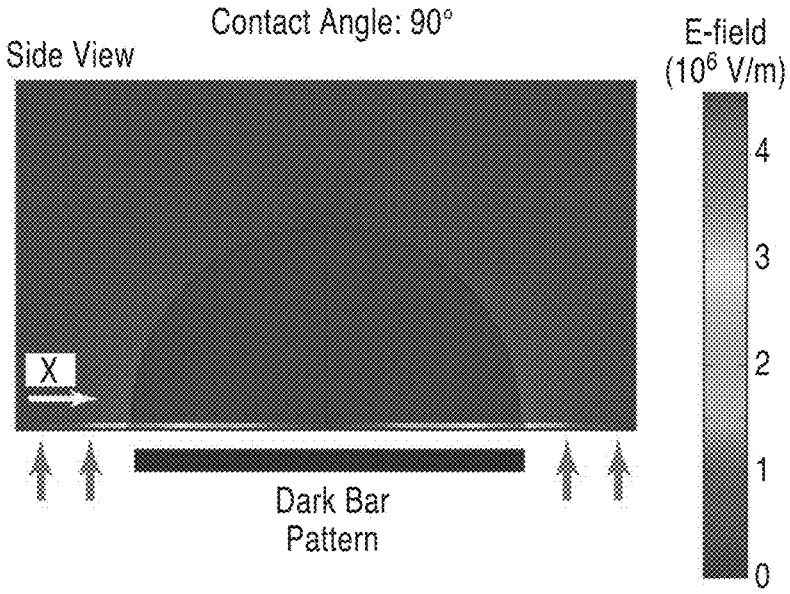
Figure 3C:
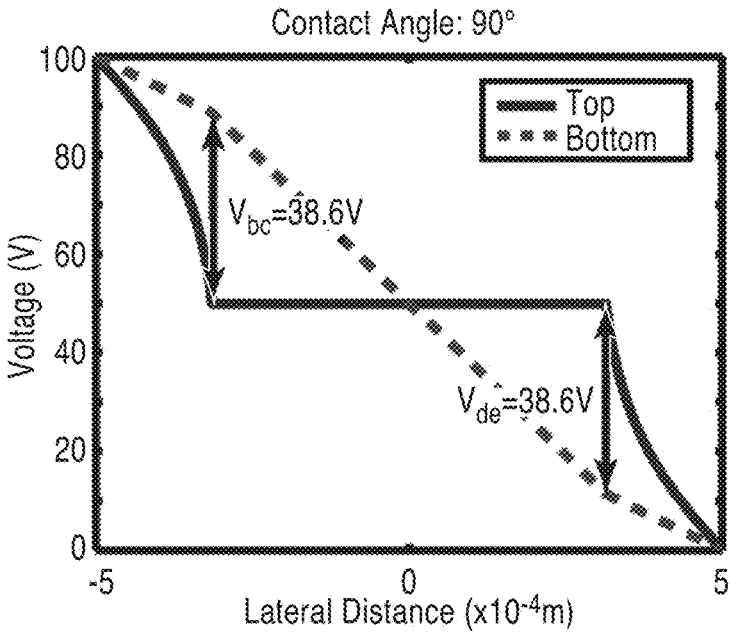
Figure 4A:
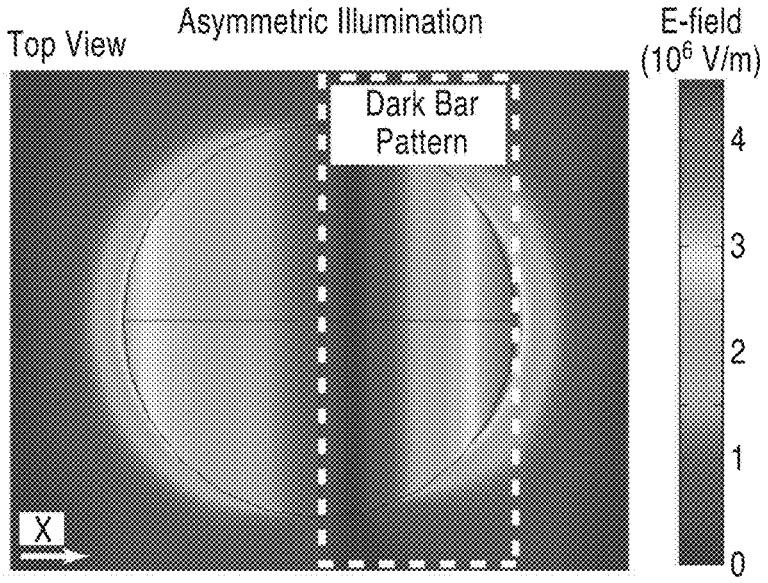
FIG. 4A through FIG. 4C are graphs of electric field simulations around a droplet under asymmetric illumination of various dark-bar patterns according to an embodiment of the present invention, showing two-dimensional patterns and voltage drops.
Figure 4B:
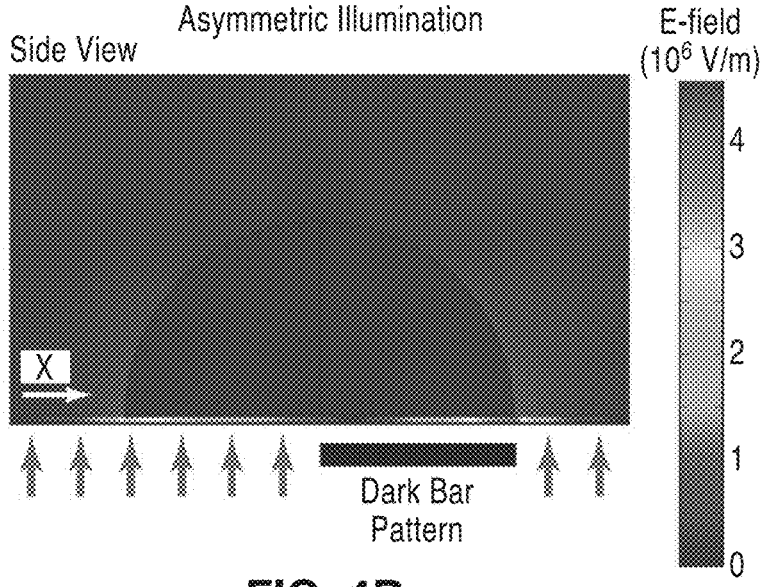
Figure 4C:
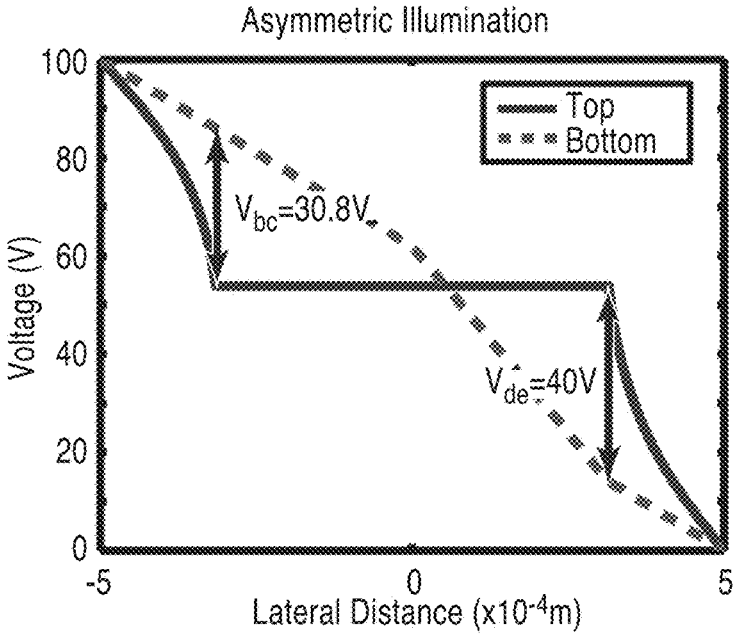

FIG. 1 illustrates an embodiment 10 of our inventive SCOEW device, and its equivalent circuit model, for directing aqueous droplets of a second fluid 14 within a first fluid (e.g., oil) wetting a dielectric layer 16, disposed over electrodes 18 and a photoconductive layer 20. The embodiment is shown by way of example implemented over a glass substrate 22.

The photoconductive layer 20 preferably comprises a semiconductor layer, such as 0.5 μm thick featureless hydrogenated amorphous silicon (a-Si:H) layer. Electrodes 18 are disposed laterally, along the plane of photoconductive layer 20, to provide a lateral electrical field in response to receiving a DC bias, and not for directing the direction of droplet transport. In the example embodiment, the electrodes 18 comprise two 0.1 μm thick strip aluminum (Al) electrodes separated by a 5 cm gap deposited at two ends of this device. A DC bias is shown applied to the two aluminum electrodes to provide a lateral electric field across the entire SCOEW device. The dielectric layer 16 is hydrophobic and, according to one embodiment, comprises a 1 μm thick amorphous fluorocarbon polymer, Cytop (CTL-809M), such as being spin-coated on the a-Si:H surface 20 to provide a hydrophobic dielectric layer.

Dynamic optical image patterns 26 are generated by a two dimensional projector or display 24 focused on the photoconductive layer 20. A control system 28 is shown coupled to biasing electrodes 18 and the display (projector) 24 for controlling operations. The control system may comprise electronics integrated with, coupled to, or in electrical connection with the SCOEW elements described. In at least one embodiment, programming is executed on a computer 30 (e.g., CPU) and associated memory 32 for controlling the dynamic optical patterns and application of bias voltage. It should be appreciated that the control system can be utilized for coordinating the operation of other microfluidic elements (not described herein) for cooperative operation with the projector/display and bias voltage. By way of example, the control system is readily executed on a personal computer, laptop, tablet computer, and so forth, or it may be integrated with SCOEW hardware such as in production setups, or combinations thereof without limitation.

Droplet actuation on the SCOEW is achieved by creating a contact angle difference between the two edges of a droplet using specifically configured light patterns. According to the Young-Lippmann equation, the contact angle of a droplet is determined by the local voltage drop across the dielectric layer between the droplet and the underlying electrodes:

$$\cos\theta = \cos\theta_0 + \frac{1}{2\gamma}cV^2$$

where c is the specific capacitance, $\gamma$ is the surface tension between the droplet and surrounding medium, and V is the voltage drop across a dielectric layer in the vertical direction at the three-phase contact line. In SCOEW, $\theta_0$ and $\theta$ represent the droplet contact angle before and after the illumination of a specific light pattern.

The operation of the SCOEW surface performing droplet actuation is qualitatively explained in the following. The photoconductive layer (e.g., a-Si:H layer) is modeled as serially connected photoresistors. The dielectric layer between a droplet and an a-Si:H layer is modeled as capacitors forming a shunt circuit. The water resistance can be neglected under the application of a DC bias due to its low electrical impedance compared to the capacitors. Without light illumination, or under uniform light illumination, the voltage linearly drops spanning the entire device in the a-Si:H layer. As a result, the voltage drop from positions "b" to "e" as illustrated in FIG. 1 is equally divided by the two capacitors, $V_{bc}=V_{de}=\frac{1}{2}V_{be}$. This implies that the contact angles at the two edges of a droplet are equal in cases with no light illumination or under uniform illumination. If two light beams with equal intensity illuminate the two photoresistors outside the droplet to decrease their resistances, the voltage $V_{be}$ will increase and cause the contact angle to decrease at the two edges of the droplet. If all photoresistors, except the one underneath the droplet, are illuminated, then $V_{bc}\neq V_{de}$ due to this asymmetrical illumination. This creates a contact angle difference at the two droplet edges and a net surface tension force is created to move the droplet toward the non-illuminated site.

Compared to prior optically-actuated electrowetting devices, there is an important and unique feature in SCOEW actuation. The dielectric capacitors and the photoresistors operate cooperatively in the device to form a shunt-equivalent circuit. The electrowetting voltage across the two capacitors is determined by the relative ratio of photoresistances between photoresistors and not their absolute values. A two-fold photoconductivity difference between the illuminated and non-illuminated sites is sufficient to induce a significant electrowetting voltage difference to actuate a droplet. This unique property allows optical actuation of droplets on a SCOEW device with low optical intensity for large area manipulation.

3. Numerical Simulation Results

Analysis using an equivalent circuit model provides a qualitative explanation of the electrowetting effect in SCOEW. To improve understanding of the electrowetting voltage drop along the three-phase contact line of a droplet, a 3D finite element model was constructed using COMSOL Multiphysics 3.2® to simulate the electric field distribution. Since the droplet size used in experiments ranges from hundreds of picoliters to tens of microliters, the diameter of a droplet is significantly larger than the thickness of the dielectric and the photoconductive layers. It should be appreciated that simulations using real dimensions require long computation times. To simplify, a 10 μm Cytop layer, a 5 μm a-Si:H, and a 550 μm thick electrically-insulating oil layer are used for simulations. A 100 V DC bias is applied at the two end planes separated by a 1 mm gap to create a lateral electric field along the X-direction. The dark conductivity and the photoconductivity in the a-Si:H layer is assumed to be $10^{-8}$ S/m and $2\times10^{-8}$ S/m, only a two-fold difference.

FIG. 2A through FIG. 2C, FIG. 3A through FIG. 3C, and FIG. 4A through FIG. 4C, illustrate a comparison of electric field simulations around a droplet sitting on a hydrophobic surface under various dark bar pattern illuminations, and associated voltage distribution profiles extracted from the top and the bottom surfaces of the dielectric layer. The voltage distribution drops ($V_{bc}$ and $V_{de}$) between these two surfaces (top and bottom) are responsible for actuating the electrowetting effect at the two edges of a droplet.

Three different situations are considered in the following examples. In FIG. 2A through FIG. 20, the initial droplet contact angle is larger than 90° (shown at 135°) in response to illumination by a dark bar pattern whose width is as wide as the droplet contact area. In this case $V_{bc}$ is equal to $V_{de}$, which means the droplet contact angles at the two edges decrease by the same amount, causing the droplet to spread out symmetrically along the X direction. In FIG. 3A through FIG. 30, the width of the dark bar pattern increases to match the width of the spreading droplet of FIG. 2A through FIG. 20 to have a contact angle of 90° and is illuminated by a wider dark bar pattern. It will be noted that the illumination of a wider dark bar in this case increases the value of $V_{bc}$ and $V_{de}$, which causes the droplet to spread out further. In FIG. 4A through FIG. 40, a dark bar pattern only illuminates only one side (e.g., right-hand side shown) of the droplet. This nonsymmetrical illumination causes a difference in the electrowetting voltage, $V_{bc}\neq V_{de}$, at the two edges of a droplet, which results in a net surface tension force that moves the droplet toward the dark bar.

4. Experimental Results

4.1 Continuous, Light-Pattern Controlled Contact Angle Modulation

One interesting feature of SCOEW is that the droplet contact angle can be continuously modulated by optical patterns according to the invention without the need of altering the applied voltage, or the use of a plurality of electrodes.

Figure 5A:
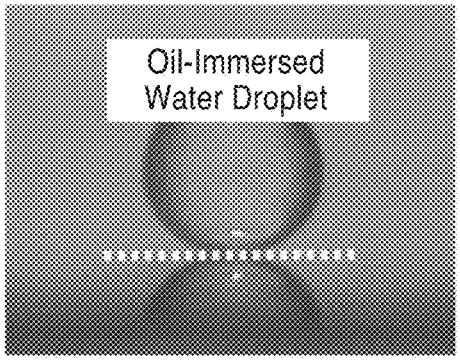
FIG. 5A through FIG. 5D are images of continuous contact angle modulation of a water droplet according to an embodiment of the present invention under various conditions.
Figure 5B:
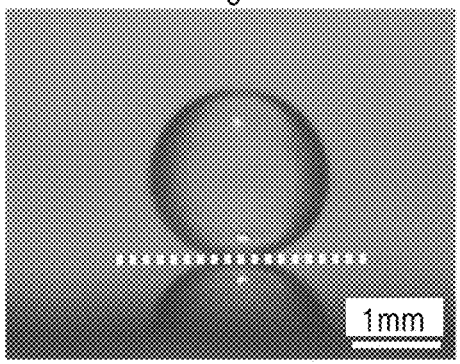
Figure 5C:
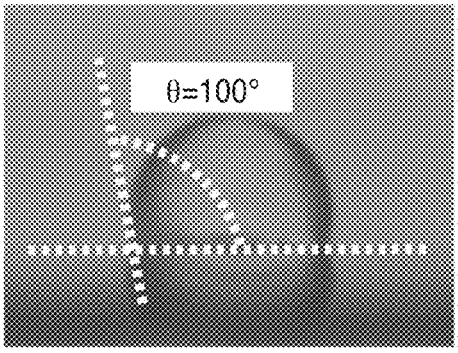
Figure 5D:
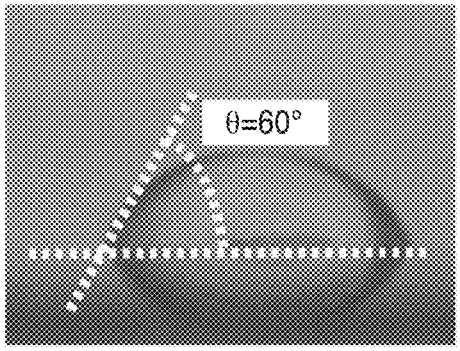
Figure 8A:
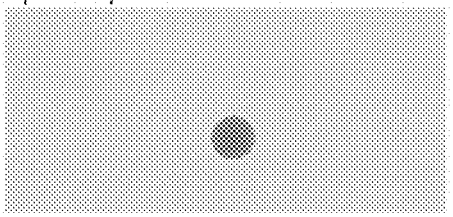
FIG. 8A through FIG. 8D are images of droplet splitting on a 1 μL droplet according to an embodiment of the present invention.
Figure 9A:
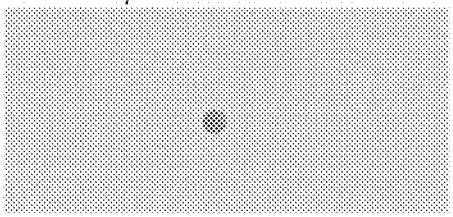
FIG. 9A through FIG. 9D are images of droplet splitting on a 20 nL droplet according to an embodiment of the present invention.
Figure 8B:
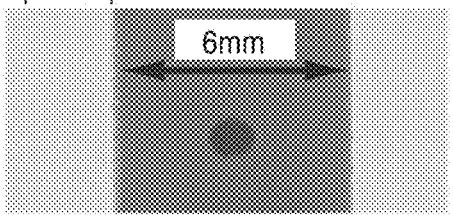
Figure 9B:
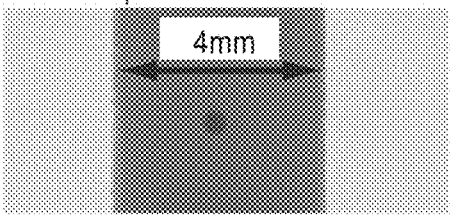
Figure 8C:
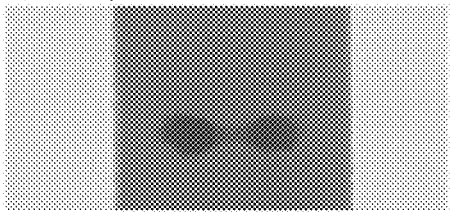
Figure 9C:
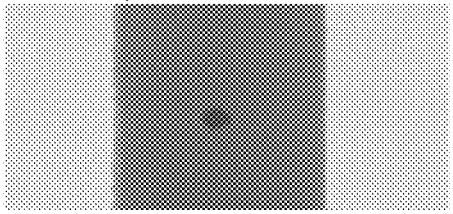
Figure 8D:
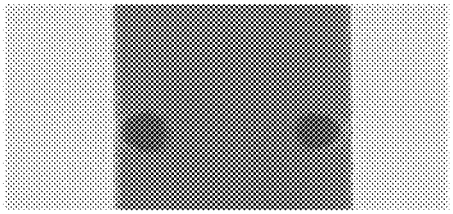
Figure 9D:
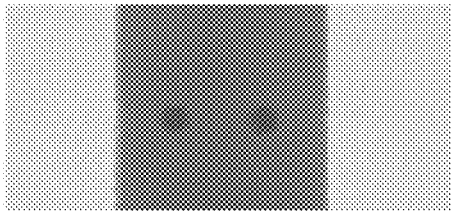
Figure 10A:
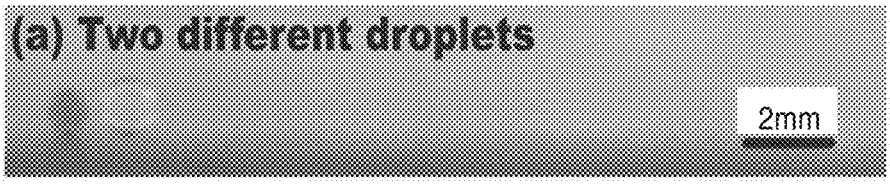
FIG. 10A through FIG. 10E are images of droplet merging and mixing according to an embodiment of the present invention.
Figure 10B:
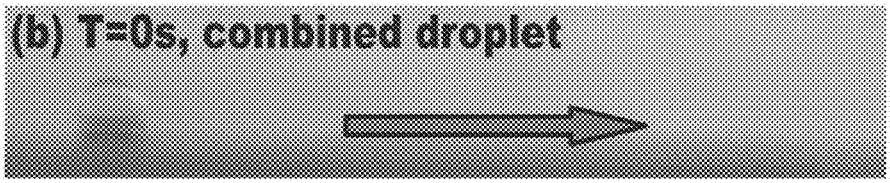
Figure 10C:
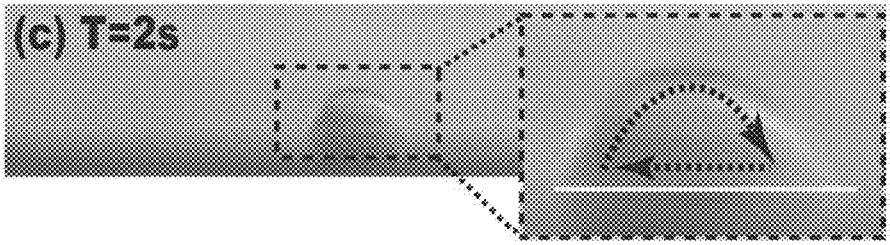
Figure 10D:
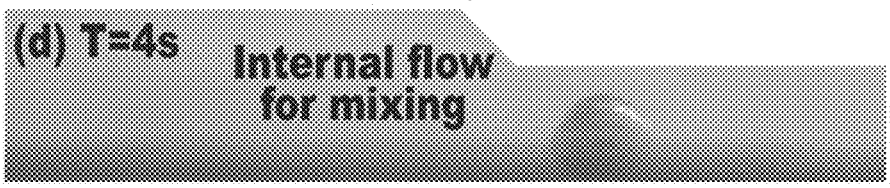
Figure 10E:
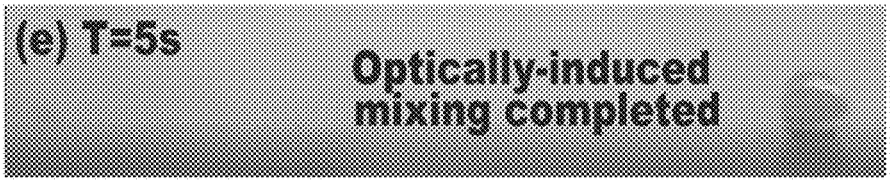

FIG. 5A through FIG. 5D are video snapshots showing continuous contact angle modulation of a 5 μL water droplet immersed in oil and positioned on top of the hydrophobic Cytop layer in SCOEW obtained in response to varying the width of the projected dark bar pattern. Without any illumination pattern a droplet is seen as a sphere in FIG. 5A prior to voltage application, and remains spherical in FIG. 5B after application of a lateral DC bias applied between the two electrodes seen in FIG. 1. When a dark bar pattern is projected in the middle of the droplet, the droplet contact angle gradually decreases as the width of the pattern slowly increases as seen in FIG. 5C through FIG. 5D, showing contact angles increasing with the width of the dark bar at 2 mm and 3.5 mm, respectively. It will be noted that in response to projecting an increasing width dark bar pattern in the middle of the droplet, the contact angle keeps decreasing and the droplet is stretched along the lateral electric field direction and reaches a contact angle of 60° as seen in FIG. 5D.

4.2 Continuous Light-Actuated Droplet Transportation

Continuous droplet transport can be achieved in SCOEW due to its featureless photoconductive layer. Droplets can be continuously addressed to any arbitrary location on a 2D surface. This property also overcomes the size limitation of pixilated electrodes in conventional EWOD and OEW devices and enables transportation of small droplets to any desired locations without the need of addressable physical electrodes.

FIG. 6A through FIG. 6C, and FIG. 7A through FIG. 7D depict video snapshots of continuous transportation of droplets. In FIG. 6A through FIG. 6C transportation of a 50-μL water droplet is seen at a speed of 17.5 mm/s in response to using a 3.5 mm wide moving dark bar pattern. By reducing the dark bar width to 100 μm in FIG. 7A through FIG. 7C, transportation of a 250 pL green-colored dye droplet (diameter~80 μm) has achieved a speed of 102 μm/s. These examples illustrate that droplets with a wide range of volume, from tens of microliters to hundreds of picoliters, can be manipulated according to the invention by simply programming the projected light pattern.

4.3 Light Triggered Droplet Splitting

Compared to droplet transportation, droplet splitting and injection from reservoirs are more challenging processes for electrowetting devices. It has been reported that to achieve droplet splitting in conventional EWOD devices would require small gap spacing between the top and bottom electrodes to provide a constraint on the droplet height, which also limits the droplet volume that can be manipulated. The smaller the droplet, the smaller the allowed gap size. In both single-sided EWOD and OEW devices with an open configuration, droplet splitting is more difficult and has not been experimentally demonstrated.

FIG. 8A through FIG. 8D and FIG. 9A through FIG. 9D depict video snapshots of light-triggered droplet splitting on an open SCOEW device embodiment. FIG. 8A through FIG. 8D depict splitting of a 1 μL green dye droplet by projective illumination of a 6 mm wide dark bar pattern, while FIG. 9A through FIG. 9D illustrate 20 nL green dye droplet splitting using a 4 mm wide dark pattern in SCOEW. It will be noted that the time period between each snapshot shown in the image sequence is 0.13 seconds.

It will be noted that the droplet initially sits on top of the SCOEW surface, and in response to a sudden illumination by a dark bar pattern, the droplet is stretched and split into two. An interesting phenomenon that has been observed during experiments is that the droplet splits only when a wide enough dark bar pattern is suddenly applied. The droplet does not split if a narrow dark bar is projected and then is followed by gradually increasing the width of the dark bar. This result implies that inertia forces could play a critical role in the droplet splitting process in SCOEW.

4.4 Droplet Merging and Mixing

FIG. 10A through FIG. 10E depict merging and mixing of multiple droplets. In the example shown, two droplets (e.g., 2 μL droplet and a 0.5 μL droplet with a dissolved green dye) are merged and mixed in a SCOEW device. Since aqueous droplets in oil medium also induce electrical dipoles, the electrostatic dipole-dipole interaction force between two closely positioned droplets causes electrocoalescence and merges them into one. It will be appreciated that mixing is accomplished by transporting the merged droplet along a zig-zag path on a SCOEW surface. During transportation, the shear force from the bottom surface enhances internal flows inside the droplet and results in droplet mixing as shown.

4.5 Light-Triggered Droplet Dispensing from External Reservoirs

Figure 11:
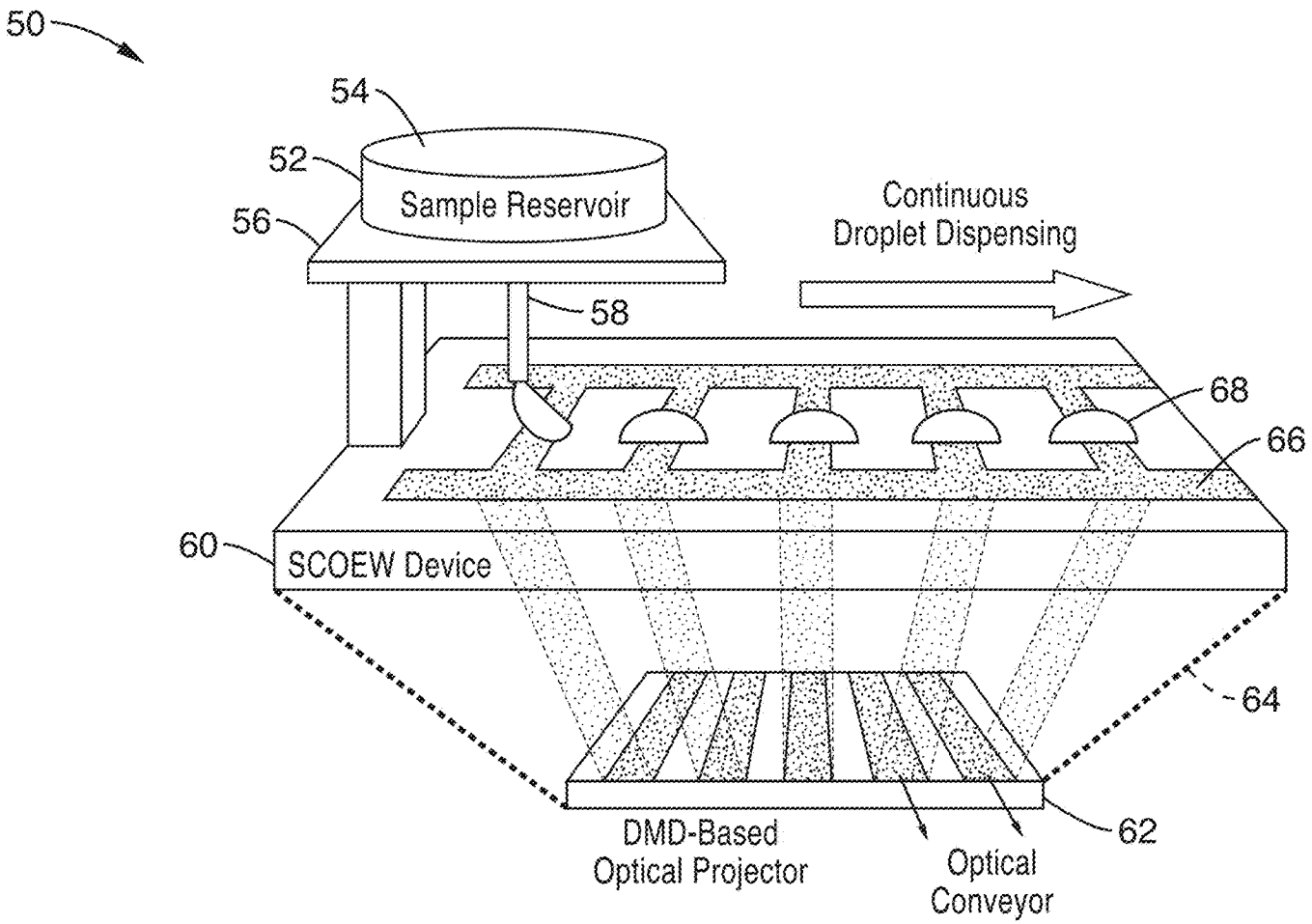
FIG. 11 is a schematic of a continuous light triggered droplet dispensing system according to an embodiment of the present invention.
Figure 12A:
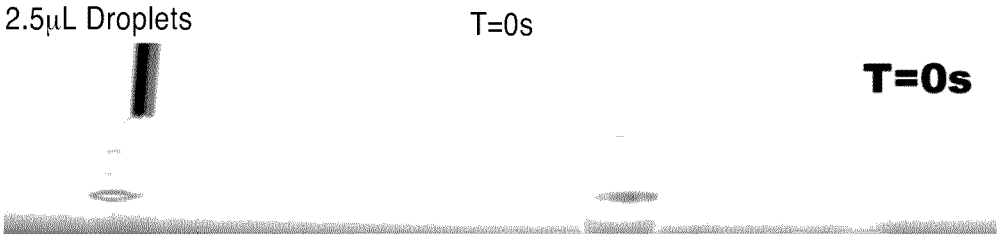
FIG. 12A through FIG. 12D are images of light triggered droplet injection according to an embodiment of the present invention.
Figure 12B:
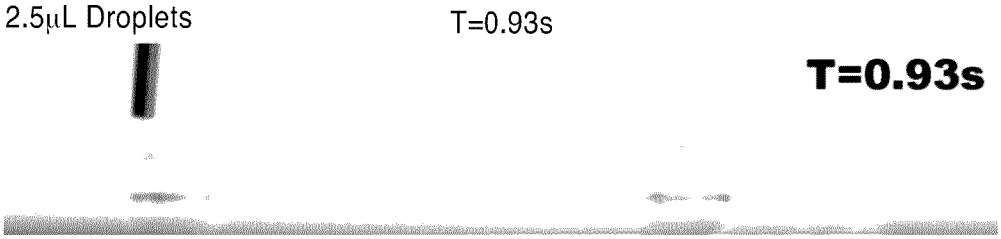
Figure 12C:
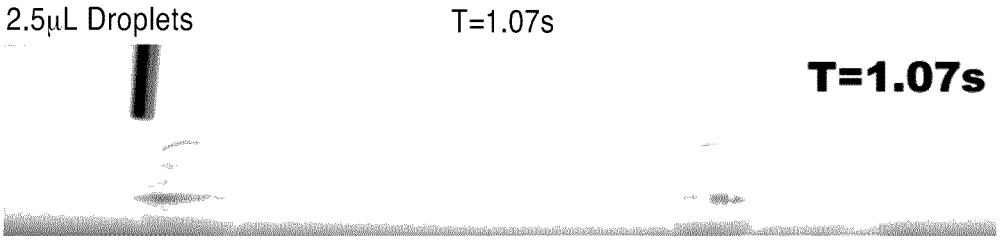
Figure 12D:
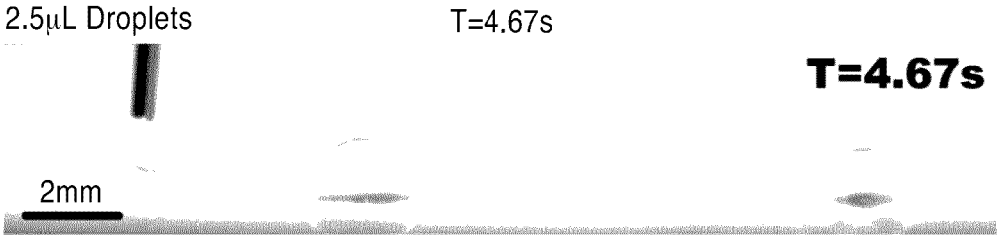

FIG. 11 illustrates an example embodiment 50 of a continuous light triggered droplet dispensing system, in which the SCOEW, as described, is integrated with an external sample reservoir through a pin connector for light-triggered droplet injection.

The open configuration of SCOEW allows flexible integration with other microfluidic components such as sample reservoirs 52, containing the fluid 54 supported on a platform 56. Droplets are dispensed through a microtube 58 (e.g., pin connector), such as having an inner diameter of approximately 500 μm, down onto a SCOEW device 60. Light patterns 64 are projected from an optical projector 62, and more preferably a digital light projector (DLP) (e.g., Digital Micromirror Device (DMD) based). Dynamic optical patterns are projected which are configured to trigger droplet injection from the external sample reservoir into a SCOEW device as droplets 68 in response to optical patterns 66 projected onto the SCOEW device. In the preferred embodiment, shown the sample reservoir is located at a position higher than the SCOEW device to provide a constant hydrostatic pressure that delivers liquid down into the oil chamber through a pin connector. In the example show, the tip of the pin is located at 2 mm above the SCOEW surface. It should be appreciated that the dispensing pressure is not restricted to gravity forces as shown in the example embodiment, but may be derived without limitation in any desired manner or combination thereof.

In the example of FIG. 11, a dynamic 1D dark bar conveyor is shown projected which moves from left to right at a constant speed of 1 mm per second. During the injection process, the size of the droplet at the tip gradually grows. When the droplet becomes sufficiently large, it makes contact with the SCOEW surface, the dark bar pattern induces the electrowetting effect to pinch off the droplet from the tip and carry it to the right.

FIG. 12A through FIG. 12D depict video snapshots demonstrating 2.5 μL droplets being continuously injected at a rate of seven (7) droplets per minute into a SCOEW device and transported away into a SCOEW chamber with respect to time {t=0, 0.93, 1.07, and 4.67 seconds).

Figure 13A:
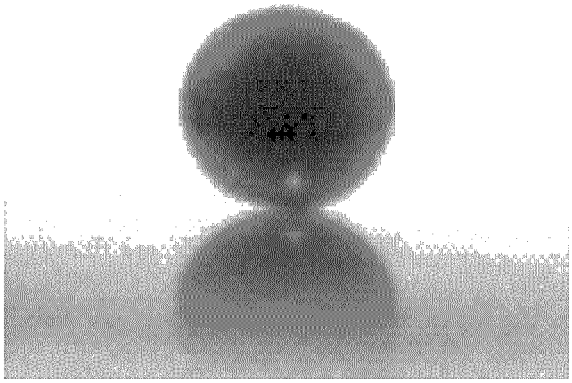
FIG. 13A and FIG. 13B are images of droplet volume uniformity for the continuous light triggered droplet dispensing system according to an embodiment of the present invention.
Figure 13B:
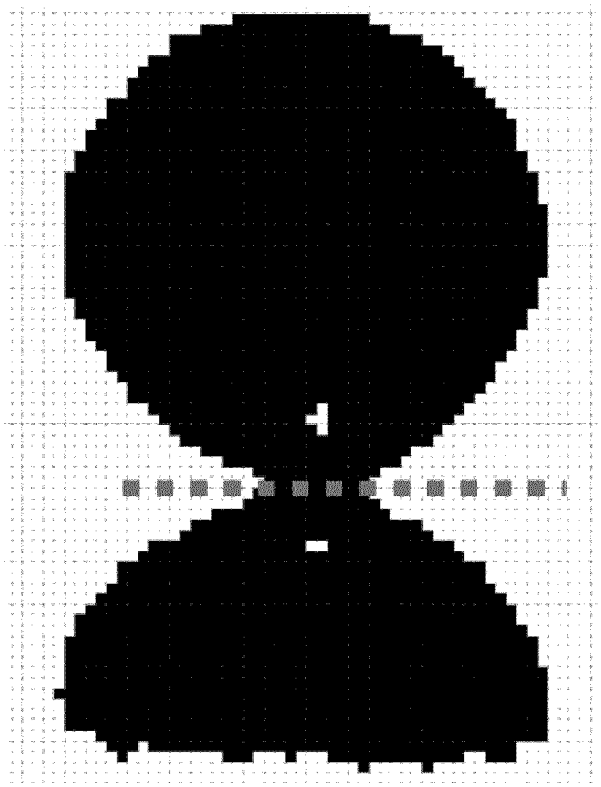

FIG. 13A and FIG. 13B illustrate that the injection process as depicted in FIG. 11 and FIG. 12A through FIG. 12D is highly reproducible. The volume variation of injected droplets was found to be less than 1%, as determined from measuring the size of droplets injected at different time frames.

Precise volume control of injected droplets is very important in many lab-on-chip applications for quantitative analyses. The volume variation of light-triggered and injected droplets in SCOEW was analyzed by taking the cross section images of injected droplets without an externally applied DC bias voltage, in which all injected droplets return to their spherical shape for easy comparisons. Using an image processing toolbox in MATLAB 7.1, color-scale droplet images are converted into digital black and white images. By counting the number of pixels enclosed by the boundaries as indicated in FIG. 13B, the volume variation of injected droplets can be estimated. For the example shown in FIG. 13B, the cross sectional area of four injected droplets was counted and was 1567±15 pixels (0.957% area variation), which corresponds to a 0.91% volume variation.

Figure 14A:
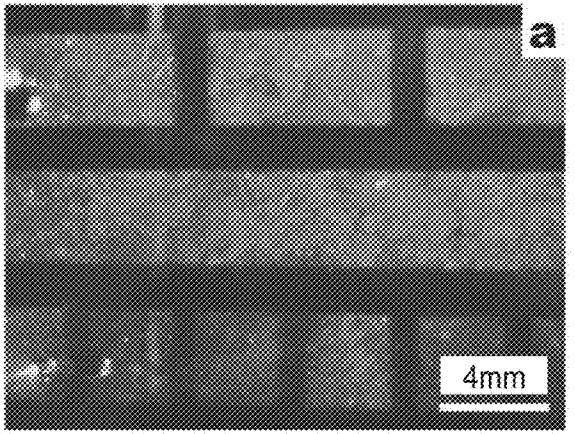
FIG. 14A through FIG. 14C are images of parallel light-triggered droplet injection from two external reservoirs according to an embodiment of the present invention.
Figure 14B:
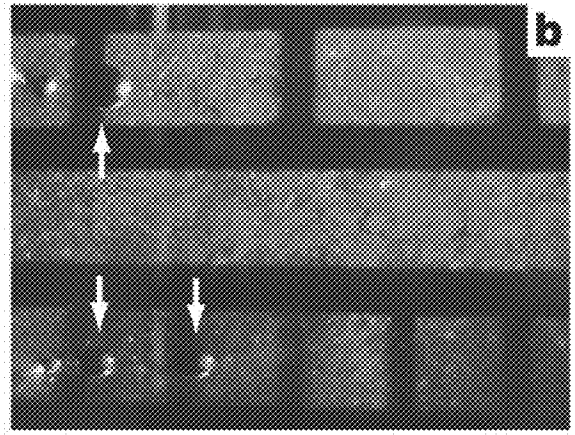
Figure 14C:
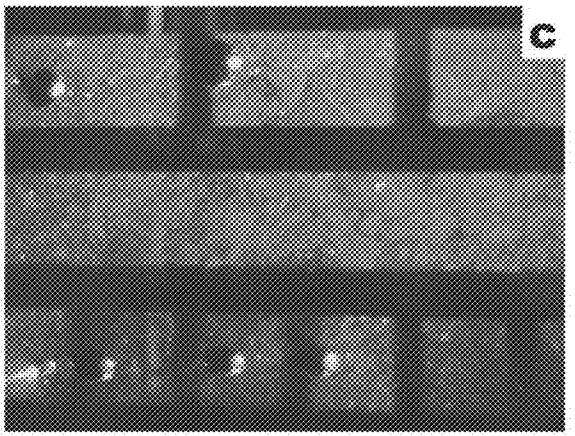
Figure 14D:
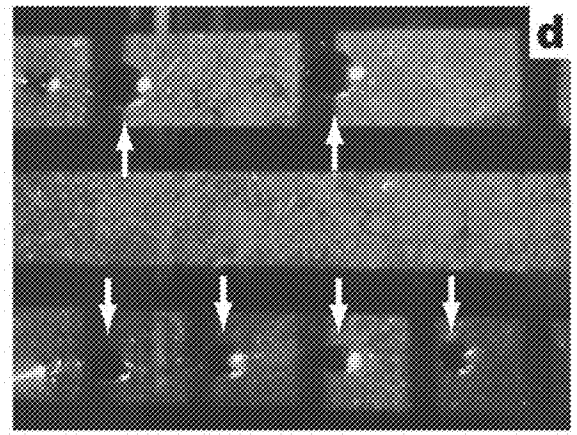

FIG. 14A through FIG. 14C depict images of parallel light-triggered droplet injection from two external reservoirs. Droplets with volumes of 1.8 μL are shown being deposited on a first conveyer in the upper row. In the bottom row conveyer 0.9 μL droplets are shown being dispensed. It is noted that the droplets are continuously injected and transported away by two dark bar conveyers with different periodicities (repetition rates). The elapsed time between each snapshot in the sequence shown is 12.94 seconds.

Parallel and volume-tunable droplet injection from multiple reservoirs has also been accomplished in the present invention by connecting multiple (microtube) pins into the SCOEW oil chamber. The above images illustrate the droplet injection from two different reservoirs using optical conveyors moving at the same speed while having different periodicities (differing lengths between respective bars). It will be noted that the dark bar periodicity in the bottom projection row is one-half that of the dark-bar periodicity in the upper row.

4.6 Droplet Actuation on an LCD Display

The low light intensity requirement of lateral field-driven optoelectrowetting mechanism enables SCOEW to be operated by simply positioning the chip on an LCD display without any additional optical components such as lenses for focusing images.

Figure 15A:
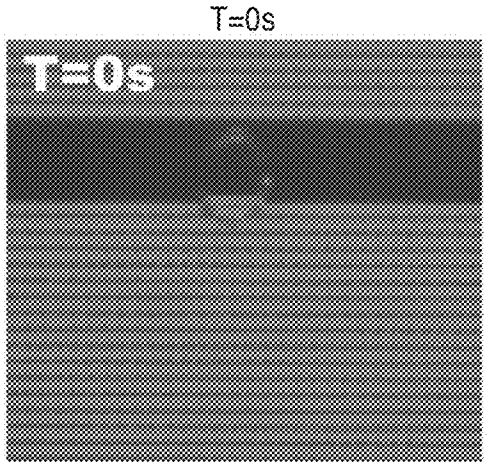
FIG. 15A through FIG. 15C are images of optical actuation of a droplet in a SCOEW device directly positioned on a low light display (e.g., LCD monitor) according to an embodiment of the present invention.
Figure 15B:
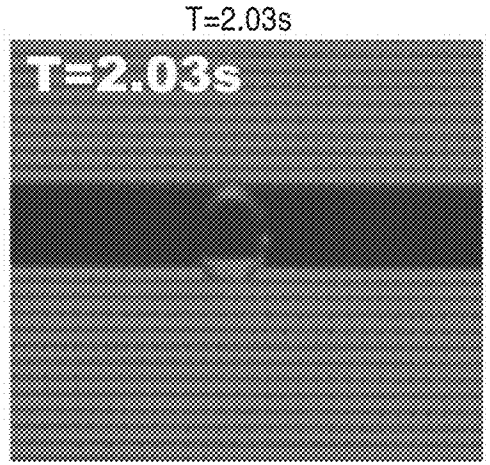
Figure 15C:
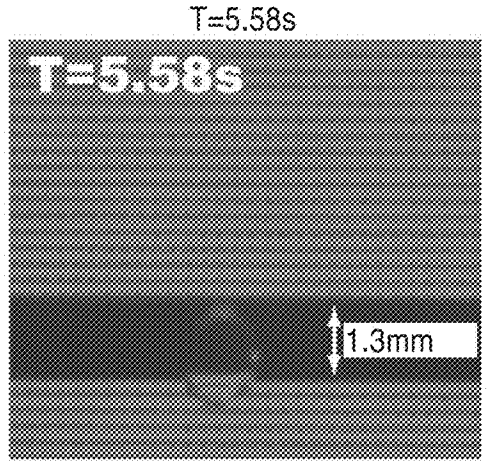

FIG. 15A through FIG. 15C depict optical actuation of a droplet in a SCOEW device directly positioned on top of the LCD display of a personal computer. In the figure shown, a 0.5 μL water droplet is transported by a 1.3 mm wide dark pattern at a speed of 510 μm/s. This low light operability allows for implementation of a variety of compact and portable SCOEW systems for massively parallel droplet manipulation.

5. Conclusions

A novel single-sided continuous optoelectrowetting (SCOEW) mechanism is taught which enables continuous optical modulation of the electrowetting effect on a single-sided, featureless, and photoconductive surface. SCOEW provides several unique features and advantages over conventional EWOD and OEW devices, including (a) continuous positioning of droplets at any location on a 2D surface; (b) transporting small droplets without size limitation determined by the physical electrode size; (c) low fabrication cost due to its featureless device structure; (d) an open chamber configuration that allows easy integration with other microfluidic components such as sample reservoirs; and (e) low-light intensity requirements for droplet actuation due to the lateral field-driven optical electrowetting modulation.

With optical patterns from a commercially available optical projector, various droplet manipulation functions have been demonstrated, including droplet transporting with volumes ranging from 50 μL to 250 pL, droplet splitting, volume-tunable parallel droplet injection from multiple reservoirs with volume variations less than 1%, and droplet merging and mixing. Droplet manipulation has also been achieved utilizing low-intensity light sources, such as an LCD display. SCOEW is expected to deliver a large-scale droplet manipulation platform for parallel droplet processing on a low cost substrate using a highly scalable, reconfigurable, and flexible optical addressing method.

From the description herein, it will be further appreciated that the invention can be embodied in various ways. The present invention provides methods and apparatus for droplet injection, movement, merging and mixing. Inventive teachings can be applied in a variety of apparatus and applications, including laboratory applications, diagnostic, pharmaceuticals and various other applications which require small droplet control.

As can be seen, therefore, the present invention includes the following inventive embodiments among others.

1. An apparatus for optically manipulating droplets within a fluid, comprising: a featureless photoconductive layer; electrodes disposed within said photoconductive layer; a voltage source configured for supplying a bias voltage to said electrodes to produce a lateral electric field; a hydrophobic dielectric layer; disposed over said photoconductive layer and configured for retaining a wetted surface of a first fluid and droplets of at least a second fluid; and an optical projector configured to focus dynamic light patterns through said hydrophobic dielectric layer to the surface of said photoconductive layer; wherein said droplets of said second fluid are subject to transport along a plane of said hydrophobic dielectric layer in response to contact angle difference between its edges which is induced in response to local voltage drop in response to receipt of said dynamic light patterns; and wherein said transport is utilized for manipulation of said droplets including addressable movement, splitting, merging and/or mixing on a single sided surface.

2. The apparatus of embodiment 1, wherein photoconductivity differs by a factor of two between illuminated and non-illuminated areas.

3. The apparatus of embodiment 1, wherein said local voltage drop comprises voltage differences between the top and bottom surfaces of the hydrophobic dielectric layer in response to said illumination.

4. The apparatus of embodiment 1, wherein said voltage source comprises a direct current (DC) bias voltage at or exceeding approximately 100 volts.

5. The apparatus of embodiment 1, wherein the contact angle of the droplet is determined by the local voltage drop across said hydrophobic dielectric layer between the droplet and the underlying electrodes as given by $$\cos\theta = \cos\theta_0 + \frac{1}{2\gamma}cV^2,$$

in which c is specific capacitance, γ is surface tension between the droplet and surrounding medium, and V is voltage drop across a dielectric layer in the vertical direction at a three-phase contact line, with $\theta_0$ and θ representing the droplet contact angle before and after illumination of said dynamic light patterns.

6. The apparatus of embodiment 1: wherein the combination of said hydrophobic dielectric layer and said photoconductive layer can be equivalently modeled with said photoconductive layer operating as serially connected photoresistors in response to said dynamic light patterns; and wherein said dielectric layer between a droplet and said photoconductive layer is modeled as capacitors forming a shunt equivalent circuit.

7. The apparatus of embodiment 1, wherein said photoconductive layer comprises a hydrogenated semiconductor layer.

8. The apparatus of embodiment 7, wherein said hydrogenated semiconductor layer comprises a hydrogenated amorphous silicon layer.

9. The apparatus of embodiment 1, wherein said hydrophobic dielectric layer comprises an amorphous fluorocarbon polymer layer.

10. The apparatus of embodiment 1, wherein said first fluid comprises an oil.

11. The apparatus of embodiment 1, further comprising: at least one reservoir from which said second fluid is dispensed through at least one aperture or microtube into said first fluid on said hydrophobic dielectric layer; wherein droplets of consistent sizing are dispensed and moved along said hydrophobic dielectric layer in response to movements of said dynamic light patterns.

12. The apparatus of embodiment 1, wherein droplets within said first fluid are stretched and split in response to sudden illumination of a dark bar in said light pattern.

13. The apparatus of embodiment 1: wherein said droplets comprise droplets of a second fluid and a third fluid transported in said first fluid along said hydrophobic dielectric layer; and wherein said light patterns are moved along the plane of said hydrophobic dielectric layer to bring droplets of said second and said third fluid into merging contact as a merged droplet.

14. The apparatus of embodiment 13, wherein said merged droplets are transported along sufficient length path to induce merging of said second and third fluid of which it is constituted.

15. The apparatus of embodiment 14, wherein said transport is performed over a zig-zag path to increase mixing rate of said merged droplet.

16. The apparatus of embodiment 1, wherein said projector comprises a pixelated flat display retained proximal to said hydrogenated semiconductor layer.

17. The apparatus of embodiment 1, further comprising a substrate layer proximal said photoconductive layer, and having sufficient transparency for said projected light to pass through said substrate layer onto said photoconductive layer.

18. An apparatus for optically manipulating droplets within a fluid, comprising: a featureless photoconductive layer of hydrogenated semiconductor; electrodes disposed within said photoconductive layer; a voltage source configured for supplying a bias voltage to said electrodes to produce a lateral electric field; a hydrophobic dielectric layer; disposed over said photoconductive layer and configured for retaining a wetted surface of a first fluid and droplets of at least a second fluid; and an optical projector configured to focus dynamic light patterns through said hydrophobic dielectric layer to the surface of said photoconductive layer; wherein said droplets of said second fluid are subject to transport along a plane of said hydrophobic dielectric layer in response to contact angle difference between its edges which is induced in response to local voltage drop in response to receipt of said dynamic light patterns; and wherein the contact angle of the droplet is determined by the local voltage drop across said hydrophobic dielectric layer between the droplet and the underlying electrodes as given by $$\cos\theta = \cos\theta_0 + \frac{1}{2\gamma}cV^2,$$

in which c is specific capacitance, $\gamma$ is surface tension between the droplet and surrounding medium, and V is voltage drop across a dielectric layer in the vertical direction at a three-phase contact line, with $\theta_0$ and $\theta$ representing the droplet contact angle before and after illumination of said dynamic light patterns.

19. The apparatus of embodiment 18, wherein said hydrophobic dielectric layer comprises an amorphous fluorocarbon polymer layer.

20. An apparatus for optically manipulating droplets within a fluid, comprising: a transparent substrate layer; a featureless photoconductive layer of hydrogenated semiconductor disposed adjacent said transparent substrate layer; electrodes disposed within said photoconductive layer; a voltage source configured for supplying a bias voltage to said electrodes to produce a lateral electric field; a hydrophobic dielectric layer of amorphous fluorocarbon polymer disposed adjacent said photoconductive layer and configured for retaining a wetted surface of a first fluid and droplets of at least a second fluid; and an optical pixelated 2D projector configured to focus dynamic light patterns through said hydrophobic dielectric layer to the surface of said photoconductive layer; wherein said droplets of said second fluid are subject to transport along a plane of said hydrophobic dielectric layer in response to contact angle difference between its edges which is induced in response to local voltage drop in response to receipt of said dynamic light patterns.

Another embodiment of the invention is a device for optically manipulating droplets within a fluid in response to optically projected illumination, without the necessity of retaining the droplets between constrictive parallel plates or requiring a plurality of electrodes for inducing transport in a desired direction.

Another embodiment of the invention is a method for performing light-patterned electrowetting modulation to provide continuous droplet manipulation on an open, featureless, and photoconductive surface.

Another embodiment of the invention is a device for optically manipulating droplets within a fluid utilizing dynamic and reconfigurable optical patterns.

Another embodiment of the invention is a device for optically manipulating droplets that enables the continuous transport, splitting, merging, and mixing of droplets.

Another embodiment of the invention is a device for optically manipulating droplets having volumes spanning over five orders of magnitude (e.g., 50 μL to 250 pL).

Another embodiment of the invention is a device for optically manipulating droplets using a unique lateral field-driven optoelectrowetting mechanism which facilitates extremely low light intensity actuation.

Another embodiment of the invention is a device for optically manipulating droplets in response to light projected from a display screen or similar two-dimensional low-light source, wherein laser light sources or projected beams are not necessary for directing droplet transport.

Another embodiment of the invention is a device for optically manipulating droplets in response to optically changing electrical field characteristics to modulate droplet contact angles in response to dark and light patterns "bars".

Another embodiment of the invention is a device for optically dispensing droplets of a tightly controlled volume along an optical conveyor.

Another embodiment of the invention is a device for optically splitting droplets on a single sided surface.

Another embodiment of the invention is a device for optically merging and mixing different droplets.

A still further embodiment of the invention is a method for manipulating droplet motion, dispensing, splitting, merging and mixing, which can be readily implemented in a variety of applications.

Those skilled in the art will appreciate that various embodiments can be implemented either separately or in any desired combination without departing from the present teachings.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for optically manipulating one or more droplets, comprising:

a featureless photoconductive layer;

a first electrode and a second electrode disposed laterally along a plane of said featureless photoconductive layer, there being a gap between said first electrode and said second electrode, wherein said featureless photoconductive layer comprises a conductive path from said first electrode to said second electrode;

a voltage source connected to said first and second electrodes for producing a lateral electric field between said first and second electrodes in said featureless photoconductive layer; and a hydrophobic dielectric layer disposed over said featureless photoconductive layer and configured for retaining a first fluid and the one or more droplets of a second fluid;

wherein each droplet of said second fluid is subject to transport along a surface of said hydrophobic dielectric layer in response to a difference between a contact angle of a first edge of said droplet with respect to said surface and a contact angle of a second edge of said droplet with respect to said surface;

wherein said difference is induced in response to a difference in optical illumination of a first region of said featureless photoconductive layer adjacent said first edge and optical illumination of a second region of said featureless photoconductive layer adjacent said second edge, said first region and said second region each forming part of said conductive path of said featureless photoconductive layer;

wherein said gap between said first electrode and said second electrode is larger than an area of said hydrophobic dielectric layer contacted by the one or more droplets of said second fluid having a volume of at least 250 picoliters; and wherein said first region and said second region are adjacent to said gap.

2. The apparatus as recited in claim 1, wherein said first and second electrodes are disposed on said featureless photoconductive layer.

3. The apparatus as recited in claim 1, wherein a thickness of said hydrophobic dielectric layer is less than or equal to ten micrometers.

4. The apparatus as recited in claim 1, wherein said voltage source comprises a direct current (DC) bias voltage.

5. The apparatus as recited in claim 1, wherein said contact angle at said first edge of said droplet is determined by a local voltage drop across said hydrophobic dielectric layer between said first edge of said droplet and said first region of said featureless photoconductive layer as given by $$\cos\theta = \cos\theta_0 + \frac{1}{2\gamma}cV^2,$$

in which c is specific capacitance, $\gamma$ is surface tension between said droplet and surrounding medium, and V is voltage drop across said hydrophobic dielectric layer in a vertical direction at a three-phase contact line, with $\theta_0$ and $\theta$ representing said contact angle at said first edge before and after said optical illumination of said first region of said featureless photoconductive layer.

6. The apparatus as recited in claim 1, wherein said featureless photoconductive layer comprises a hydrogenated semiconductor layer.

7. The apparatus as recited in claim 6, wherein said hydrogenated semiconductor layer comprises a hydrogenated amorphous silicon layer.

8. The apparatus as recited in claim 1, wherein said hydrophobic dielectric layer comprises an amorphous fluorocarbon polymer layer.

9. The apparatus as recited in claim 1, wherein said first fluid comprises an oil.

10. The apparatus as recited in claim 1, further comprising:

at least one reservoir from which said second fluid is dispensed through at least one aperture or microtube into said first fluid on said hydrophobic dielectric layer;

wherein the one or more droplets of consistent sizing are dispensed and moved along said hydrophobic dielectric layer in response to movements of dynamic light patterns optically illuminating said featureless photoconductive layer.

11. The apparatus as recited in claim 1 further comprising an optical projector configured to focus dynamic light patterns onto said featureless photoconductive layer, wherein said dynamic light patterns comprise said optical illumination of said first region of said featureless photoconductive layer and said optical illumination of said second region of said featureless photoconductive layer.

12. The apparatus as recited in claim 1, further comprising a substrate layer proximal said featureless photoconductive layer, and having sufficient transparency for said optical illumination to pass through said substrate layer onto said featureless photoconductive layer.

13. The apparatus as recited in claim 1 further comprising a fluidic chamber configured to retain said first fluid and said one or more droplets of said second fluid, wherein said featureless photoconductive layer and said first and second electrodes are part of a same wall of said fluidic chamber.

14. The apparatus as recited in claim 1 further comprising a fluidic chamber configured to retain said first fluid and said one or more droplets of said second fluid, wherein said featureless photoconductive layer and said first and second electrodes are on a same side of said fluidic chamber.

15. The apparatus as recited in claim 1, wherein said first and second electrodes and said gap are parallel to said surface of said hydrophobic dielectric layer.

16. The apparatus as recited in claim 1, wherein said first and second electrodes are disposed between said hydrophobic dielectric layer and said featureless photoconductive layer.

17. The apparatus as recited in claim 1, wherein said first and second electrodes are disposed on a same surface of said featureless photoconductive layer, which is parallel to said surface of said hydrophobic dielectric layer.

18. The apparatus as recited in claim 1, wherein said difference in optical illumination at said first region and said second region of said featureless photoconductive layer creates a corresponding difference between a first electrical conductivity of said conductive path at said first region and a second electrical conductivity of said conductive path at said second region.

19. The apparatus as recited in claim 18, wherein said difference between said first electrical conductivity of said conductive path at said first region and said second electrical conductivity of said conductive path at said second region creates a difference between a first voltage drop from said surface of said hydrophobic dielectric layer at said first edge of said droplet to said first region of said conductive path and a second voltage drop from said second region of said surface of said hydrophobic dielectric layer at said second edge of said droplet to said second region of said conductive path.

20. The apparatus as recited in claim 19, wherein:

said conductive path is parallel to said surface of said hydrophobic dielectric layer, and said first voltage drop and said second voltage drop are perpendicular to said surface of said hydrophobic dielectric layer.

21. The apparatus as recited in claim 11, wherein said projector comprises a pixelated flat display.

22. The apparatus as recited in claim 4, wherein said DC bias voltage is at least 100 volts.

23. The apparatus as recited in claim 1, wherein each of said one or more droplets are subject to transport along said surface of said hydrophobic dielectric layer within a region above said gap between said first electrode and said second electrode.

24. The apparatus as recited in claim 1, wherein each of said one or more droplets have a volume in a range from 50 microliters to 250 picoliters.

25. The apparatus as recited in claim 1, wherein said gap has size in a range from an area of said hydrophobic dielectric layer contacted by the droplet of said second fluid having a volume of 250 picoliters to a size of 5 cm.

26. The apparatus as recited in claim 1, wherein said gap between said first electrode and said second electrode has a size of 5 centimeters.

* * * * *